US006712042B1

(12) United States Patent
Kustosch

(10) Patent No.: US 6,712,042 B1
(45) Date of Patent: Mar. 30, 2004

(54) METHOD AND ARRANGEMENT FOR EQUALIZING AT LEAST TWO CYLINDER BANKS OF AN INTERNAL COMBUSTION ENGINE

(75) Inventor: Mario Kustosch, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/697,312

(22) Filed: Oct. 27, 2000

(30) Foreign Application Priority Data

Oct. 27, 1999 (DE) ..... 199 51 581

(51) Int. Cl.[7] ..... F02P 5/00

(52) U.S. Cl. ..... 123/406.23; 123/406.47; 123/436

(58) Field of Search ..... 123/399, 436, 123/406.23, 406.47, 406.24

(56) References Cited

U.S. PATENT DOCUMENTS 3,606,869 A * 9/1971 Huntzinger et al. ..... 123/478
4,688,535 A 8/1987 Küttner et al.
4,773,372 A 9/1988 Stumm et al.
RE33,890 E * 4/1992 Ohnari et al. ..... 123/479
5,390,650 A * 2/1995 Gee et al. ..... 123/692
5,570,574 A * 11/1996 Yamashita et al. ..... 60/276
5,875,411 A * 2/1999 Volkart et al. ..... 701/110
5,893,897 A * 4/1999 Volkart et al. ..... 701/110
6,032,648 A * 3/2000 Mayer et al. ..... 123/406.14
6,155,105 A * 12/2000 Klenk et al. ..... 73/117.3

* cited by examiner

*Primary Examiner*—Willis R. Wolfe
*Assistant Examiner*—Johnny H. Hoang
(74) *Attorney, Agent, or Firm*—Walter Ottesen

(57) ABSTRACT

The invention is directed to a method and an arrangement for equalizing at least two cylinder banks of an internal combustion engine wherein a control parameter is corrected. The control parameter influences the torque contributions of the cylinder banks when a deviation in the quantities is determined. These quantities represent the torque contributions of the cylinder banks.

7 Claims, 2 Drawing Sheets

10
Control Apparatus
12
16
Output Circuit
22
20
48
47
Measuring Device
WPED
34
32
14
50
Measuring Device
N mot
Computer Unit
42
36
52
Measuring Device
18
18
40
54
55
Measuring Device
46
80
82
DK2
DK1
Input Circuit

METHOD AND ARRANGEMENT FOR EQUALIZING AT LEAST TWO CYLINDER BANKS OF AN INTERNAL COMBUSTION ENGINE

BACKGROUND OF THE INVENTION

U.S. Pat. 4,773,372 discloses an internal combustion engine having at least two power-adjusting elements which can be electrically driven independently of each other. In engines of this kind, different torque amounts of the cylinder banks can occur whose air is supplied via different power adjusting elements, that is, these cylinder banks have separate intake manifolds. The different torque amounts are caused by the different charges of the cylinders because the supplied air mass flow is dependent, inter alia, on the following: the geometry of the power-adjusting element (the throttle flap), the different characteristic lines of the actual value transducer of the power-adjusting element in so-called electronic gas pedal systems and/or on different leakage flows. The actual value transducer of the power-adjusting element can be a potentiometer of the throttle flap and the different leakage flows occur, for example, via the throttle flaps, the tank-venting valves, the crankcase venting, the exhaust-gas return valves, the brake amplifier, et cetera. The different cylinder charges which result therefrom and therefore the different torque amounts lead, however, to an operating performance of the engine which is not completely satisfactory.

SUMMARY OF THE INVENTION

It is an object of the invention to provide measures with the aid of which an equalization of the cylinder banks takes place with reference to the torque contributions thereof.

The method of the invention is for equalizing at least two cylinder banks of an internal combustion engine. The method includes the steps of: controlling each of the cylinder banks with at least one control variable; determining a quantity representing the torque contributions of the cylinder banks; and, correcting the at least one control variable in dependence upon the quantity in the sense of an equalization of the torque contributions of the cylinder banks.

U.S. Pat. 4,688,535 discloses the determination of a quantity, which represents the differences in the torque contributions of individual cylinders, by evaluating segment times and to supply this quantity for the equalization of the cylinders.

A procedure is provided with which the equalization of cylinder banks takes place in a simple manner with the air supply of the cylinders being influenced by power-adjusting elements controlled independently of each other. It is of special advantage that the cylinder equalization takes place via a corresponding equalizing intervention via the throttle flaps of the engine and that the ignition angle need not be shifted or shifted only to a limited extent for equalization. In this way, significantly greater torque differences between the cylinder banks can be compensated. In addition, fuel is saved because the ignition angle can be held in the optimal region and exhaust-gas emissions are reduced because the ignition angle can be used more for combustion optimization than for the cylinder equalization.

It is especially advantageous that especially in idle, the torque-increasing capability of an ignition angle shift remains ensured because the ignition angle is not applied or is only applied to a limited extent for cylinder equalization.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
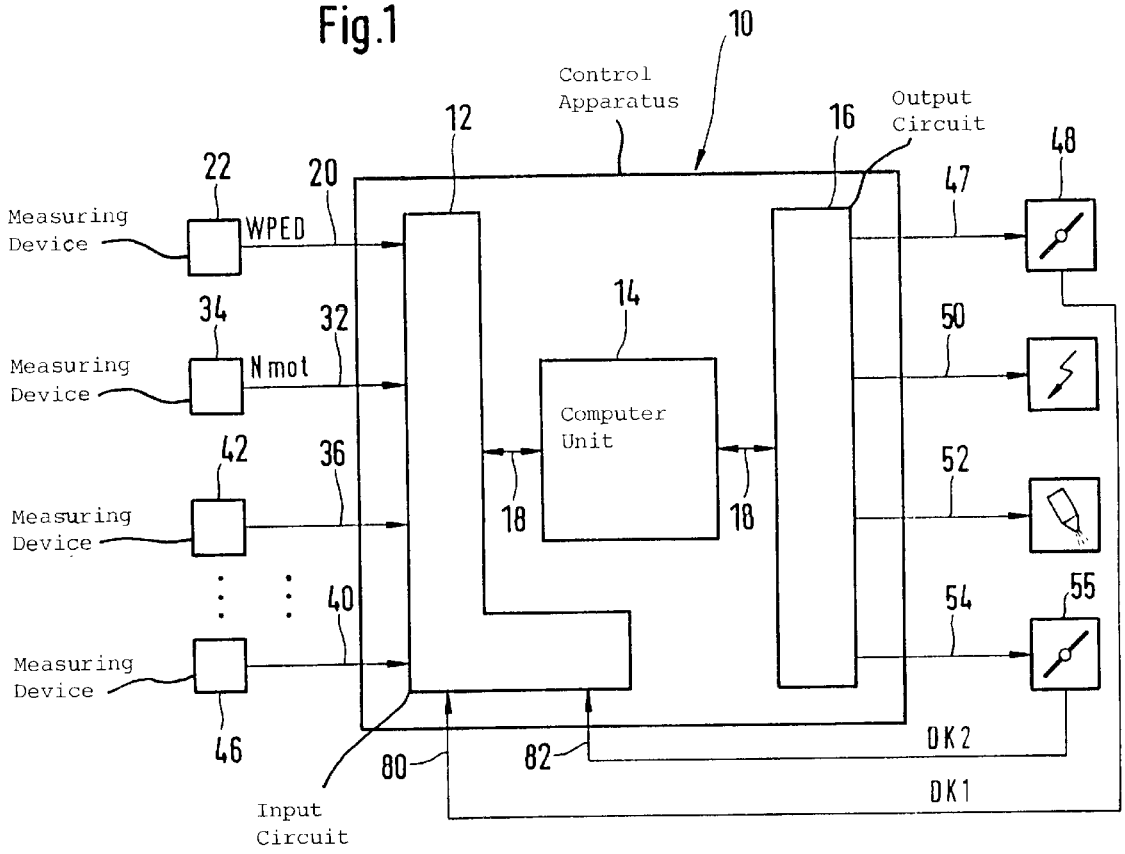
FIG. 1 shows a control arrangement for controlling an internal combustion engine with at least two electrically independently driven power-adjusting elements and the corresponding number of cylinder groups (cylinder banks); and, FIG. 2 shows a preferred embodiment of the method of the invention for realizing the equalization of the cylinder groups or cylinder banks in the context of a flowchart representing a computer program for carrying out the equalization.

FIG. 1 shows an electronic control apparatus 10 which includes at least an input circuit 12, at least a computer unit 14 and at least an output circuit 16. Input circuit, computer unit and output circuit are connected with each other via a communication system 18 for mutual data exchange. The following input lines lead to the input circuit 12: an input line 20 from a measuring device 22 for detecting a measurement quantity (WPED) for the position of an operator-actuated element actuated by the driver such as an accelerator pedal and input lines 36 to 40 from measuring devices 42 to 46. The measuring devices 42 to 46 provide additional operating variables of the drive unit and/or of the vehicle which are necessary for carrying out the functions executed by the control apparatus 10. These additional operating quantities include inducted air temperature, engine temperature, ambient pressure, exhaust-gas composition, et cetera. A signal, which represents the engine rpm Nmot, is supplied via input line 32 to the input circuit 12 from a measuring device 34. Segment times are detected which are assigned to the individual cylinders (for example, via a crankshaft angle transducer or a camshaft angle transducer). A segment corresponds to the angle of a complete engine revolution (with reference to the crankshaft, it is 720°) divided by the number of cylinders. The time which is needed to run through this angle is known as the segment time. Ignition and injection are computed anew with the frequency of the segment time. Furthermore, signals DK1 and DK2 are supplied via the input lines 80 and 82 to the input circuit 12. These signals represent the current position of these at least two power-adjusting elements (throttle flaps).

The electronic control apparatus 10 controls the actuating elements via the output circuit 16 in accordance with the detected measurement quantities, especially in accordance with the measurement quantities of at least one of the measurement quantities determined by the measuring device 22. A first power-adjusting element 48 is driven via a first output line 47 and a second power-adjusting element 55 is driven via a second output line 54. Both power-adjusting elements are electrically actuable throttle flaps in the preferred embodiment. The positions of the throttle flaps are detected by corresponding measuring devices and are supplied to the control apparatus via the lines 80 and 82. The ignition time point of the individual cylinders is set via output lines 50 and the metering of fuel to the individual cylinders is adjusted via lines 52.

In another embodiment, a control apparatus is provided for each cylinder group or each cylinder bank. This control apparatus controls the throttle flap, ignition angle and fuel metering of the assigned cylinder group or cylinder bank.

The measurement quantity WPED represents the position of the operator-controlled element and is read in by computer 14 and converted into desired values for driving the power-adjusting elements 48 and 55. This conversion is done, for example, by means of characteristic lines, characteristic fields, tables or computation steps, if needed, while considering additional operating variables. These desired values are adjusted in the context of a position control loop by forming drive signals. This position control loop is closed by the feedback of the position of the particular power-adjusting element. The position of the particular power-adjusting element determines the charge which is supplied to the cylinder group or cylinder bank assigned to the power-adjusting element. The charge for each of the groups or banks has different values for the same desired value because of different characteristics of the power-adjusting elements as well as of the intake manifolds. This charge for each of the groups or banks is adjusted by the adjustment of the power-adjusting elements and the deviation can amount to some 10%. Different torque amounts of the individual cylinder groups result as a consequence of the different charge of the individual cylinders. This behavior is unwanted so that adaptation methods for equalizing the cylinder banks are carried out. These lead to the condition that the controls of the power-adjusting elements are influenced in such a manner that the torque amounts of the individual cylinder groups or individual cylinder banks are essentially the same.

With the aid of the rpm, the rough running of an internal combustion engine (spark ignition engine or diesel engine) is determined. For this purpose, the time is measured in which the crankshaft rotates precisely by one segment. The segment time is the time which elapses in passing this segment (angle region) and this segment time is utilized for detecting misfires as well as for cylinder equalization. The currently measured segment time is assigned in the cylinder equalization to the cylinder which has last been ignited. If the segment time of a cylinder is noticeably short or long compared to the mean value of the previous segment times of all cylinders, then this is interpreted as an excess or inadequate torque of the affected cylinder. In a four-cylinder engine wherein the crankshaft rotates twice per engine revolution, a segment of this kind has an angle of 180° of the crankshaft rotation. The segment times are monitored primarily in steady-state operating states such as in idle.

This basic procedure can also be applied when engines having at least two cylinder banks with different cylinder-bank specific torque contributions are present. Bank-specific differences in the torque can be determined from an allocation of the igniting cylinder and its segment time to its cylinder bank. Cylinder bank specific differences in torque for engines having at least two cylinder banks as mentioned above occur, for example, when the cylinder banks have intake manifolds which are separate from each other. In the context of a cylinder equalization, the cylinder bank specific torque differences are detected in that the mean value of the quantities (such as the segment times) is formed as described above. These quantities represent the torque contributions of the cylinders of a bank. Only segment times, which originate from cylinders of this cylinder bank, are applied for the mean value formation of a cylinder bank because the assignment of the last igniting cylinder to the particular cylinder bank is known. If a deviation is detected between the determined cylinder bank specific segment times (for example, the mean value of the segment times) then these are compensated. Preferably, a corresponding correction for at least one of the throttle flap positions but also a shift of the ignition angle of the cylinder of one or both cylinder banks takes place. For example, for equalization, a pregiven offset factor is arithmetically coupled to the desired value for the throttle flap position. This offset factor effects the equalization of the cylinder banks.

In another embodiment, the offset values are considered with the input of the cylinder bank individual torque desired values in the context of a torque oriented control structure. These offset values are derived from the determined deviations of the torque contributions of the individual banks. The correct components are added to the bank specific desired torques. The described procedure is applied in spark-ignition engines having intake manifold injection or diesel engines having several cylinder banks.

The time-dependent intervals of the combustion operations of the individual cylinders of the cylinder banks or the intervals of the ignitions of respective cylinders are applied in lieu of the detection of segment times in other embodiments in a corresponding manner.

Figure 2:
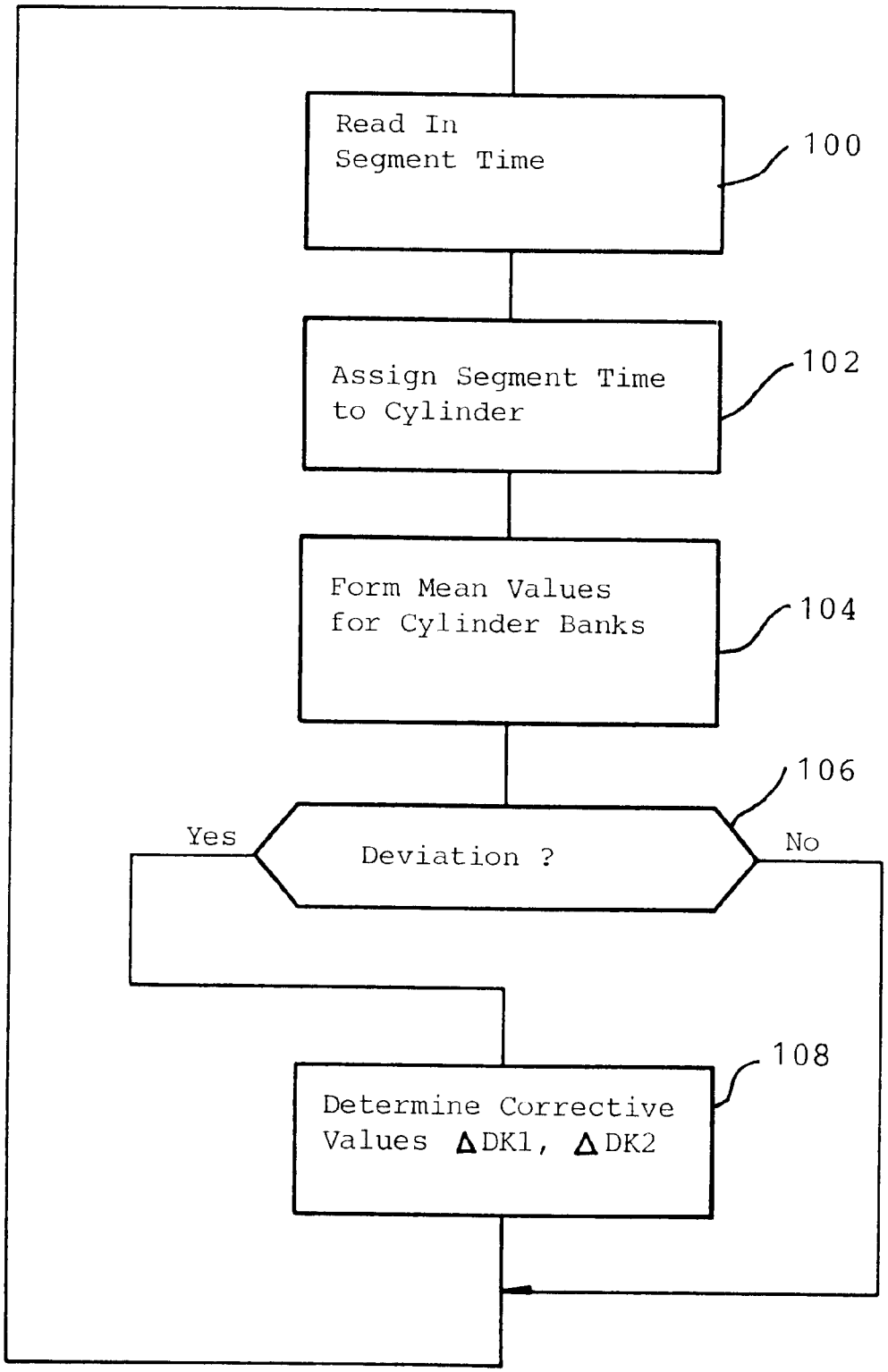

In the preferred embodiment, the above-described procedure is realized as a program of the computer 14. In FIG. 2, a flowchart is shown which realizes the above-described procedure as such a computer program. This program is run through in dependence on rpm.

In a first step 100, the segment time, which is determined by means of another program, is read in and, in the next step, the segment time is assigned to the last-ignited cylinder (step 102). This assignment is achieved because of the fixed pregiven mechanical connection between the position of the crankshaft or camshaft of the engine to the cylinder position in accordance with a table. After the assignment of the current segment time to a cylinder, mean values for each bank are determined from past segment times of the cylinders of the particular cylinder banks (step 104). Thereupon, in step 106, a check is made as to whether a deviation between these mean values of the banks is present. If this is not the case, the program is repeated in the next revolution step with step 100; otherwise, the corrective values for the throttle flap values or torque values are determined in step 108 in correspondence to the magnitude of the deviation.

In another program (not shown), the corrective value, which is formed in step 108, is considered in the determination of the adjustment of the throttle flap or of the torque of the engine.

In a diesel engine, the fuel quantity to be injected is corrected for cylinder equalization in lieu of the throttle flap position.

The correction of the fuel quantity is undertaken also in spark-ignition engines as an alternative or supplementary to the correction of the throttle flap adjustment and/or the ignition angle change for the equalization of the cylinder banks.

If, for each cylinder bank, a separate control unit is provided, then the mean values of the segment times for each bank are formed in the particular control unit and the offset values are determined in a selected control unit.

The equalization of the banks or groups takes place in dependence upon the embodiment via the following: the control of the throttle flaps or other adjusting elements controlling the air supply to the engine, the fuel metering and/or the ignition angle. Here, for each bank or group, at least one control quantity (control quantities for the throttle flap, the fuel metering and/or the ignition angle) is correspondingly corrected.

It is understood that the foregoing description is that of the preferred embodiments of the invention and that various changes and modifications may be made thereto without departing from the spirit and scope of the invention as defined in the appended claims.

What is claimed is:

1. A method for equalizing at least two cylinder banks of an internal combustion engine, the method comprising the steps of:

controlling each of the cylinder banks with at least one control variable;

determining a quantity representing the torque contributions of said cylinder banks; and correcting said at least one control variable in dependence upon said quantity in a sense of an equalization of said torque contributions of said cylinder banks.

2. The method of claim 1, comprising the further steps of detecting segment times assigned to cylinders of said cylinder banks; and deriving said quantity from the following: the segment times, a spacing of two combustion operations in a cylinder or a spacing of ignitions in a cylinder of the corresponding cylinder bank.

3. The method of claim 1, comprising the further step of correcting a setting of a power adjusting element in dependence upon a value representing a deviation of said torque contributions of said cylinder banks.

4. The method of claim 2, wherein said quantity is the mean value of said segment times and wherein the method further comprises correcting a setting of a power adjusting element in dependence upon a deviation of the mean values of said cylinder banks.

5. The method of claim 1, wherein said internal combustion engine is a diesel engine; and, wherein the method comprises the further step of correcting a quantity of fuel to be injected.

6. The method of claim 1, wherein said internal combustion engine is a spark ignition engine; and, wherein the method comprises the further step of adjusting at least one of the following: a power adjusting element, an ignition angle of at least one cylinder of a cylinder bank and a metering of fuel.

7. An arrangement for equalizing at least two cylinder banks of an internal combustion engine, the arrangement comprising:

a control apparatus for controlling the at least two cylinder banks by outputting at least one control variable; and said control apparatus including means for determining quantities representing the torque contributions of said cylinder banks; and means for correcting said at least one control variable in dependence upon said quantities in a sense of an equalization of said torque contributions of said cylinder banks.

* * * * *